US007574965B2

(12) United States Patent
Scherrer et al.

(10) Patent No.: US 7,574,965 B2
(45) Date of Patent: Aug. 18, 2009

(54) HEIGHT-ADJUSTMENT DEVICE

(75) Inventors: Kurt Scherrer, Münsingen (CH); Alexander Schärer, Gümligen (CH)

(73) Assignee: USM Holding AG, Gumligen (CH)

( * ) Notice: Subject to any disclaimer, the term of this patent is extended or adjusted under 35 U.S.C. 154(b) by 0 days.

(21) Appl. No.: 11/127,275

(22) Filed: May 12, 2005

(65) Prior Publication Data

US 2005/0274303 A1 Dec. 15, 2005

(30) Foreign Application Priority Data

Jun. 11, 2004 (EP) ..... 04405361

(51) Int. Cl.
*A47B 9/20* (2006.01)

(52) U.S. Cl. ..... 108/147.19; 108/147.11

(58) Field of Classification Search ..... 108/147, 108/147.19, 144.11, 106; 248/188.1, 188.2, 248/188.5, 274.1, 288.11, 289.11, 292.12; 403/109.1, 109.7
See application file for complete search history.

(56) References Cited

U.S. PATENT DOCUMENTS

| | | | | |
|---|---|---|---|---|
| 3,587,482 | A * | 6/1971 | Wieland | 108/147 |
| 3,943,844 | A * | 3/1976 | Standbridge et al. | 100/343 |
| 4,593,874 | A | 6/1986 | Dunagan | |
| 5,088,421 | A | 2/1992 | Beckstead | |
| 5,601,037 | A * | 2/1997 | Meyer et al. | 108/147 |
| 5,709,441 | A * | 1/1998 | Bartling et al. | 312/107 |
| 5,809,908 | A * | 9/1998 | Catta et al. | 108/147 |
| 5,890,438 | A | 4/1999 | Frankish | |
| 5,937,699 | A * | 8/1999 | Garrec | 74/89.35 |
| 5,989,368 | A * | 11/1999 | Tillander et al. | 156/64 |
| 6,026,755 | A * | 2/2000 | Long | 108/147 |
| 6,148,741 | A * | 11/2000 | Motta | 108/96 |
| 6,289,825 | B1 * | 9/2001 | Long | 108/147 |
| 6,378,446 | B1 * | 4/2002 | Long | 108/147 |
| 6,382,039 | B1 * | 5/2002 | Choi | 74/89.35 |
| 6,435,048 | B1 * | 8/2002 | Zimmerman | 74/89.35 |
| 6,484,648 | B1 * | 11/2002 | Long | 108/147 |
| 6,494,669 | B2 * | 12/2002 | Bernard et al. | 414/800 |
| 6,584,917 | B2 * | 7/2003 | Long | 108/147 |
| 6,626,605 | B1 * | 9/2003 | Dean et al. | 403/344 |
| 2003/0033963 | A1 * | 2/2003 | Doyle | 108/147.19 |

FOREIGN PATENT DOCUMENTS

| | | | |
|---|---|---|---|
| DE | 19642592 | A1 | 4/1998 |
| DE | 19815234 | A1 | 10/1999 |
| EP | 0129941 | A1 | 1/1985 |
| EP | 283103 | * | 9/1988 |
| EP | 0283103 | A1 | 9/1988 |
| FR | 2747280 | * | 10/1997 |
| FR | 2747280 | A1 | 10/1997 |

* cited by examiner

*Primary Examiner*—José V Chen
*Assistant Examiner*—Matthew W Ing
(74) *Attorney, Agent, or Firm*—Birch, Stewart, Kolasch & Birch, LLP

(57) ABSTRACT

In the case of a height-adjustment device for a table (1) with three or more table legs (3.1 . . . 3.4) arranged in an edge region of the table, with respectively adjacent table legs (3.1 . . . 3.4) being connected to one another by a horizontal, hollow-profile connecting element (4.1 . . . 4.4), each of the table legs (3.1 . . . 3.4) comprises a telescopic mechanism for changing a length of the table leg (3.1 . . . 3.4), which mechanism can be adjusted by rotating a rotatably mounted adjusting element (7.1 . . . 7.4). A plurality of coupling elements (9.1 . . . 9.4) are accommodated within the connecting elements (4.1 . . . 4.4) and are arranged in such a manner that each of the adjusting elements (7.1 . . . 7.4) of the table legs (3.1 . . . 3.4) is mechanically synchronized with the adjusting elements (7.1 . . . 7.4) of the adjacent table legs (3.1 . . . 3.4) by means of separate coupling elements (9.1 . . . 9.4).

12 Claims, 6 Drawing Sheets

HEIGHT-ADJUSTMENT DEVICE

TECHNICAL FIELD

The invention relates to a height-adjustment device for a table with three or more table legs arranged in an edge region of the table, with respectively adjacent table legs being connected to one another by a horizontal, hollow-profile-like connecting element. Each of the table legs comprises a telescopic mechanism for changing its length, which mechanism can be adjusted by rotating a rotatably mounted adjusting element. The invention furthermore relates to a table having a height-adjustment device and to a method for retrofitting a table with a height-adjustment device.

PRIOR ART

Desks and drawing tables with a table top, the inclination and height of which can be set in accordance with the users' requirements, have been known for a relatively long time. However, now it is frequently desirable, even in the case of tables with, in particular, horizontal table tops which cannot be adjusted in inclination, such as work tables and conference tables and tables in the domestic sector, for the height of the table top to be able to be adjusted. In the case of conference tables and, for example, dining tables, this permits adaptation to the seating furniture which is used together with the table and is generally not height-adjustable; in the case of work tables, an ergonomically correct sitting position adapted to the users' height is made possible together with correctly setting the seating furniture.

In the case of tables of this type, during the height adjustment it has to be ensured that the inclination of the table top remains constant and that the top, for example, always takes up a horizontal position. This is achieved in the case of known tables for example by the fact that there is only a single, central foot which is of height-adjustable design. Tables are also known which have two lateral feet, the height-adjustment mechanisms of which are coupled electrically or mechanically.

For aesthetic reasons and therefore as little leg room as possible being taken up for the supporting structure of the table top, tables with three or more table legs arranged in an edge region of the table are often used. In this case, there is the problem that the height-adjustment of more than 2 spaced-apart supporting elements has to be synchronized with one another.

U.S. Pat. No. 5,088,421 (Beckstead) shows, for example, a work desk with a vertically adjustable worktop which has, at its corners, four table legs which are connected laterally and on the rear side by means of plates. A table surround which has a rectangular profile and supports the table top is mounted on the legs. The four table legs each have a spindle drive for the height adjustment. Triangular frames having in each case one bearing for one of the spindles are fastened in the corners of the surround. All of the spindles are synchronized with one another by means of a single, encircling chain which runs along the inside of the surround. The chain is driven by a motor via a driving pinion.

However, users of the table may injure themselves on the chain, which is arranged in an open manner, and the chain may result in soiling, for example by means of lubricants. In addition, the arrangement of the chain and of the bearings for the spindles is not satisfactory aesthetically for tables of modern design.

This problem may be solved by a protective element being provided in which the chain is accommodated.

FR 2 747 280 (B I 2 S S.A), for example, discloses a height-adjustable underframe for furniture in the hospital sector, for example for beds or baths. The underframe is formed by a rectangular frame with two longitudinal tubes and transverse tubes arranged in between, with a respective vertical, height-adjustable, three-part telescopic foot with casters being fastened to the corners. A motor is arranged on the frame and drives a pinion which interacts with a drive chain which is guided in channels in the longitudinal and transverse tubes of the frame (page 3, lines 28-35). The drive chain interacts in the telescopic feet with a spindle, on the upper end of which a pinion is arranged in a rotationally fixed manner. The three-part telescopic foot is extended or retracted via the external thread of the spindle.

DE 198 15 234 A1 (Förster) discloses a work table with a plurality of table legs which can be adjusted in their length. All of the table legs can be changed simultaneously and uniformly in their length via a mechanism which can be actuated manually or by motor. The height adjustment takes place, for example, by means of threaded spindles. The transmission of the torque between all of the adjusting mechanisms can take place via a cable or a V-belt or toothed belt which interacts with corresponding pulleys on the spindles and runs in the frame supporting the table top.

Chains are relatively heavy and expensive and require regular maintenance. V-belts or toothed belts are lighter, more cost-effective and virtually maintenance-free, but prone to changes in length. The belts encircling in the furniture frame are quite long, with the result that even a small relative change in length is sufficient so that the contact between the belt and the corresponding pulleys is no longer ensured or that the table underframe is distorted due to the forces which occur. In addition, during the production or retrofitting of the table, an encircling belt can only be inserted into the encircling table frame if the frame is appropriately constructed, i.e. can be appropriately divided or, for example, has a continuous longitudinal slot, or if the belt can be divided and reconnected. The longitudinal slot is not desirable for aesthetic and safety reasons and a dividing point makes the belt more expensive and less durable.

SUMMARY OF THE INVENTION

It is the object of the invention to provide a height-adjustment device which belongs to the technical field mentioned at the beginning and can be produced and fitted reliably, aesthetically inconspicuously and simply.

The manner in which the object is achieved is defined by the features of Claim 1. According to the invention, the height-adjustment device comprises a plurality of coupling means which are accommodated within the connecting elements and are arranged in such a manner that each of the adjusting elements of the table legs is mechanically synchronized with the adjusting elements of the adjacent table legs by means of separate coupling means.

An individual coupling means which synchronizes two of the adjusting elements with each other has a smaller spatial extent than an individual coupling means which has to synchronize all of the adjusting elements with one another. Changes in length therefore take place to a smaller extent, thus ensuring reliable operation. In addition, the separate coupling means can be arranged in such a manner that fitting into the connecting elements is possible in a simple manner even if the elements are closed, i.e., for example, are essentially tubular.

The separate coupling means can therefore, in particular, also permit the retrofitting of already existing tables with a height-adjustment device. For this purpose, in the case of a table with table legs arranged in an edge region of the table, with respectively adjacent table legs being connected to one another by a horizontal, hollow-profile-like connecting element, the following steps are implemented:

a) replacing the table legs by height-adjustable table legs with a telescopic mechanism for changing a length of the table leg, the telescopic mechanism being adjustable by rotating a rotatably mounted adjusting element;
b) for two adjacent table legs in each case introducing a coupling means for the mechanical synchronization of the adjusting elements of the adjacent table legs into the connecting element connecting the table legs; and
c) coupling the coupling means to the adjusting elements.

An example of a table for which the height-adjustment device according to the invention is suitable comprises a rectangular, horizontally oriented table top in the four corners of which a respective table leg is arranged. Along the edge of the table top, hollow-profile-like surrounds run between the table legs as connecting elements. The surrounds and the table legs can together form a mechanically stable table underframe on which the table top is merely placed. For additional stabilization the table top may also be screwed to the surrounds. As an alternative, the table legs may be connected directly to the table top, and the connecting elements provide additional stabilization or, in addition to accommodating the coupling means, are used for primarily aesthetic purposes. A separate coupling means is accommodated in each of the connecting elements and is used to synchronize the adjusting elements of the table legs adjacent to the connecting element.

Telescopic mechanisms for changing the length of table legs are known per se. They may comprise two or more telescopic elements which are mounted one inside another and can be adjusted relative to one another. The telescopic elements may have, for example, a cylindrical shape or another prismatic shape. From top to bottom, the telescopic elements may have a cross section which rises in a stepwise manner or decreases in a stepwise manner such that the inner wall of an element can be mounted in a sliding manner on the outer wall of the corresponding, adjacent element.

The adjusting elements are preferably vertical spindles which interact with a telescopic element of the telescopic mechanism via a thread. A mechanism of this type is stable and structurally simple in that the rotational movement, which is transmitted to the adjusting element, is used directly for the vertical displacement of the spindles or of the telescopic element interacting therewith. The spindles may be designed both as hollow spindles with an internal and/or external thread and also as solid spindles with an external thread.

As an alternative, the rotational movement of the adjusting elements can be transmitted indirectly to a spindle mechanism or another height-adjustment mechanism, for example by the adjusting elements being vertical profiled tubes which interact with corresponding profiled pins on a spindle. Devices for changing the length of a table leg are also conceivable, in which the rotational movement of the adjusting element is transmitted, for example, to a toothed wheel which interacts with a toothed rack or in which the rotational movement in a hydraulic pump is used.

The coupling means are advantageously endless, and a driving part is connected in a rotationally fixed manner to each of the spindles. The coupling means are arranged in such a manner that they encircle the driving parts of the spindles of the adjacent table legs and interact therewith. In this manner, a purely mechanical synchronization of the telescopic mechanisms of adjacent table legs is realized, the synchronization being simple, cost-effective, low in maintenance and easy. The driving part may be formed integrally on the spindle, or it is, for example, screwed, riveted, welded or bonded to the spindle or placed onto the spindle in a form-fitting manner.

As an alternative, the adjusting elements of two adjacent table legs are synchronized, for example, via bevel gear drives and a shaft arranged in between.

The endless coupling means are preferably belts, in particular toothed belts, or chains. Belts are light, cost-effective and maintenance-free or low in maintenance. Form-fitting belts, such as, for example, toothed belts, also ensure, by virtue of the form-fitting connection to the driving parts, that the synchronization between the spindles is always maintained. In addition to toothed belts, use may also be made, for example, of V-belts or flat belts, if appropriate together with corresponding belt tighteners which are arranged, for example, in the connecting elements. When chains of metal, plastic or a composite material are used, the synchronization between the spindles is likewise ensured, and the risk of change in length is also minimized in comparison to other endless coupling means.

Since a separate endless coupling means is used in each case for the synchronization of the spindles of adjacent table legs, the possible, material-dependent change in length is reduced in comparison to a longer endless coupling means which is to simultaneously synchronize all of the spindles. In addition, the contact surface between the coupling means and the driving part of the spindle is enlarged because, for example, in the case of a rectangular table the coupling means encircles each driving part by approximately 180° and not only by 90°. Both result in increased operational reliability and an increased service life of the height-adjustment device.

Spacers are preferably arranged in the connecting elements, for guiding the two opposite sections of the endless coupling means in the connecting elements. The spacers avoid wedging of the two parallel, opposed sections of the endless coupling means that are guided in a connecting element. Depending on the shape of the connecting element, they are used to prevent wedging between the coupling means and the inner wall of the connecting element. A relevant tightening device for the coupling means is advantageously likewise formed on the spacers or fastened thereto. Depending on the length of the connecting elements and on the distance between the two sections of the coupling means, it is possible for just two spacers to be arranged on the two outer ends of the connecting element, or for a plurality of spacers to be arranged spaced-apart along the connecting element, or one spacer can extend essentially over the entire length of the connecting element. Given a sufficient spacing of the sections of the endless coupling means, two spacers arranged at the ends are preferred because they can easily be fitted in the connecting element and only contribute a little additional weight, particularly if they are manufactured from a lightweight material, such as plastic.

As an alternative, if the spacing between the two sections of the endless coupling means is of a sufficient size, with possible changes in length being taken into consideration, spacers in the connecting elements can be entirely omitted.

The device preferably comprises guides for the endless coupling means, the guides having an external cross section which corresponds essentially to an internal cross section of the table legs. The guides comprise a longitudinally oriented mount for the driving part and laterally arranged openings for guiding the coupling means through. Owing to its shape and its dimensions, the guide can be accommodated in a fitting manner in the table leg, so that it can be fastened therein in a simple manner, without spacers or other retaining devices.

Each coupling means which interacts with the spindle enters through the laterally arranged opening, encircles the driving part and leaves again through the same or through a further lateral opening parallel to the entering section. The shaping of the guide is selected in such a manner that the endless coupling means is guided precisely around the driving part. Over tightening or over jumping of the coupling means with respect to the driving part and therefore the loss of precise synchronization between the table legs can therefore be prevented without additional tighteners being required for the coupling means.

The arrangement and the size of the openings in the bearings can be freely selected as a function of the dimensions of the coupling means, the guide and the driving part, for example, a plurality of coupling means can be guided through a single large opening or through a plurality of smaller openings. The openings may be shaped in such a manner that their outer edges form guides through which the coupling means is guided in the transition between the table leg and the surrounds. So that the assembly is simplified, it may be advantageous for the two sections of a coupling means to be guided in each case through the same opening. After the installation of the coupling means, the opening may be divided by an additional element into two subopenings, the additional element serving at the same time as a spacer or being able to be formed on a spacer.

Each of the guides is preferably formed by means of at least three guide bushings arranged longitudinally one behind another, with two openings for the coupling means being formed at two different longitudinal ends of the guide bushings. For the coupling means, a respective opening is therefore formed at the transition between the first and the second bushing and at the transition between the second and the third bushing, with a plurality of configurations being possible by the openings optionally being able to be formed in the outer bushing or in the central bushing or else in both bushings. The openings are closed axially in each case by the adjacent bushing, so that the coupling means is securely guided by the guide and held laterally.

Each of the guides is advantageously formed by precisely three identical guide bushings which can be plugged one inside another with a different orientation. In particular in the case of guide bushings which are produced in a compression moulding process or compression casting process (for example injection moulding), this has the advantage of just a single mould having to be provided instead of three (or more) different moulds, as a result of which costs are saved. The ability to be plugged one inside another permits simple joining together and ensures that the bushings are fixed in their orientation with respect to one another. The guide bushings preferably have, at one of their longitudinal ends, an opening for the coupling means. Two of the guide bushings are arranged in such a manner that the corresponding openings are aligned with the coupling means to be accommodated, in the case of a rectangular table, the two openings are, for example, at an angle of 90° with respect to each other. The opening of the third guide bushing is not used.

As an alternative, two or three different designs of guide bushings can be provided, for example those without and those with an opening. The bushings may also be welded, bonded or screwed to one another, or their relative orientation is secured by means of a bolt which can be pushed longitudinally through all of the bushings.

The telescopic mechanism of one of the table legs is preferably designed in such a manner that an actuating means for the user for adjusting the height of the table can be coupled directly in a rotationally fixed manner to the adjusting element. This enables a manual adjustment of the table height in a simple manner. By synchronizing the telescopic mechanisms of the other table legs, a uniform adjustment of the table height is ensured.

As an alternative or in addition, the table-height-adjustment device may also comprise an electric drive which is coupled either to the adjusting means of one of the telescopic mechanisms or to a coupling means. An additional, manually actuable driving part which interacts with a coupling means away from the table legs is also possible.

The telescopic mechanism of each of the table legs advantageously has a coupling for the optional coupling of the actuating means. The coupling may be designed, in particular, as a plug-in connection onto which a crank can be plugged as actuating means. The plug-in connection may be formed as a recess, for example as a hexagon socket, or as a projection in an end part of the table leg, which part is mounted rotatably in the table leg and is connected in a rotationally fixed manner to the adjusting element. Since each of the table legs has the abovementioned coupling, during the actuation of the height adjustment attention does not need to be paid to where the actuating means is fitted. In addition, a recess is particularly advantageous as plug-in connection because, when the height adjustment is not in use, a flat cover can be placed in a simple manner onto the end part of the table leg, which cover has, for example, an elastic projection which engages in the recess and holds the cover on the end part.

As an alternative, the coupling is provided just on one or on some of the table legs. In addition, the actuating means may also be coupled permanently to the adjusting element and, depending on the torque required, may be designed, for example, as a hand wheel or lever which can be unfolded.

The connecting elements preferably run between the table legs, and lateral openings for guiding the coupling means through into the connecting elements are provided in the table legs. Each coupling means which interacts with the adjusting element therefore leaves the connecting element through an end-side opening of the connecting element and the corresponding lateral opening in the table leg and is mechanically coupled behind it to the adjusting element. The arrangement and the size of the openings may be selected freely as a function of the type and dimensions of the coupling means and of the adjusting element; it is also possible for a plurality of lateral openings for the same coupling means to be provided in one table leg. The connecting elements may be arranged at the upper end of the table legs and, for example, aligned by means of their upper side with the upper end of the table legs, thus forming an encircling surround. A configuration of this type makes it possible for the table top to be placed onto the connecting elements or to be fastened thereto. The connecting elements may also be arranged further downwards, spaced apart from the table top, the table top in this case being supported by the table legs.

As an alternative, the connecting elements may be arranged at the top on the table legs, i.e. the table legs are fitted at the bottom to the connecting elements which are joined together in the manner of a frame. In this case, the coupling elements run entirely within the connecting elements. Either mechanical connections to the adjusting elements of the telescopic mechanisms are provided, or the adjusting elements pass through an opening formed at the bottom in the corner regions of the connecting elements and, after assembly, are therefore likewise positioned within the connecting elements.

Further advantageous embodiments and combinations of features of the invention emerge from the detailed description below and the patent claims in their entirety.

BRIEF DESCRIPTION OF THE DRAWINGS

In the drawings used for explaining the exemplary embodiment.

In principle, the same parts are provided with the same reference numbers in the figures.

WAYS OF IMPLEMENTING THE INVENTION

Figure 1:
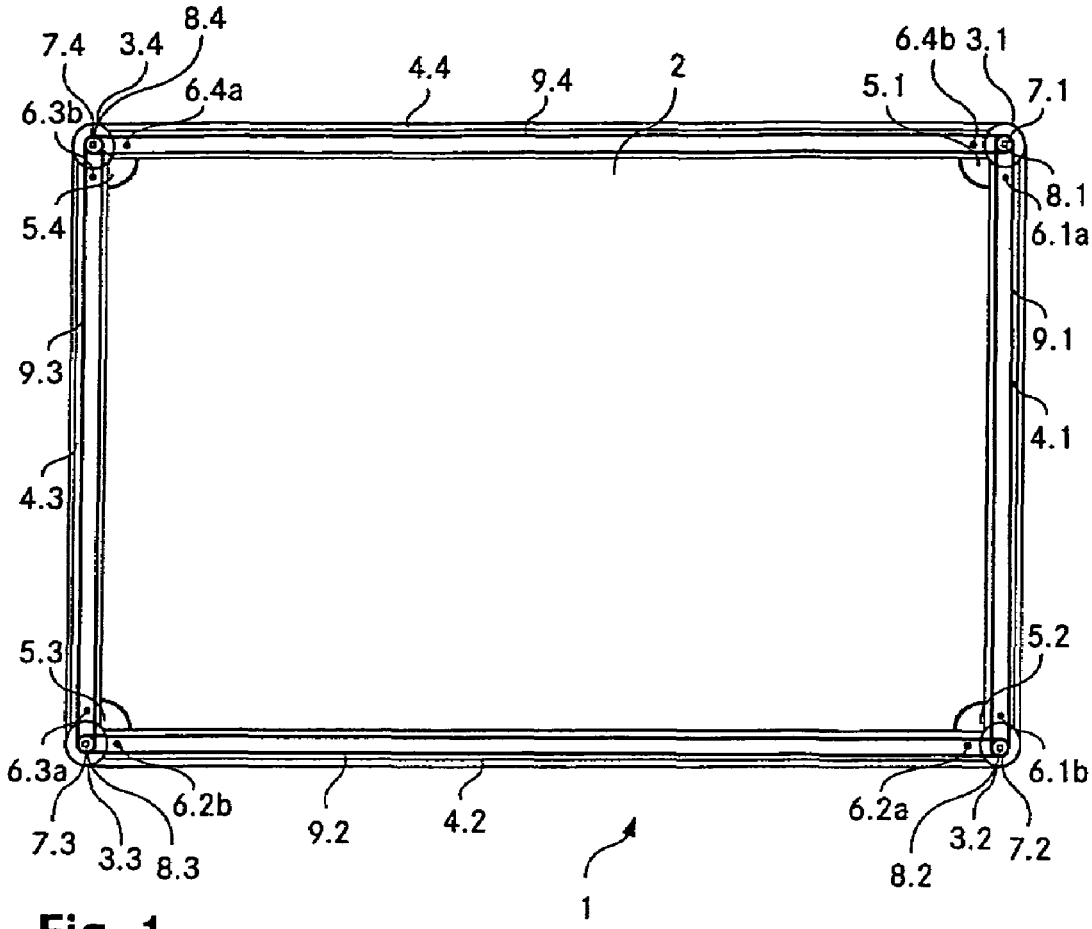
FIG. 1 shows a diagrammatic illustration of a table with a height-adjustment device according to the invention in a plan view of the table top.

FIG. 1 shows a diagrammatic illustration of a table with a height-adjustment device according to the invention in a plan view of the table top. For better clarity, the illustration is not drawn to scale. A table leg 3.1, 3.2, 3.3, 3.4 is arranged in each of the four corners of the essentially rectangular table top 2 of the table 1. The table legs 3.1 . . . 3.4 have a circular cross section and are aligned with the two adjacent edges in each case of the table top 2. In the corners, the table top 2 has cutouts matched to the cross section of the table legs 3.1 . . . 3.4, so that the table top 2 can be placed between the upper ends of the table legs 3.1 . . . 3.4. The table top 2 is mounted on hollow-profile-like surrounds 4.1, 4.2, 4.3, 4.4 with a rectangular cross section which are arranged between the table legs 3.1 . . . 3.4 in a manner such that they are slightly set back from the outer edges of the table top 2.

The two surrounds 4.1 . . . 4.4 adjacent in each case to one of the table legs 3.1 . . . 3.4 are connected to one another and to the respective table leg 3.1 . . . 3.4 by means of a respective corner element 5.1, 5.2, 5.3, 5.4. The corner elements 5.1 . . . 5.4 are arranged below the table top 2 adjacent to the surrounds 4.1 . . . 4.4 and the respective table leg 3.1 . . . 3.4 on the inside of the surround. For fastening the corner elements 5.1 . . . 5.4, openings are provided on the inner side of the surrounds 4.1 . . . 4.4, adjacent to the table legs 3.1 . . . 3.4, into which openings claws and cams formed on the corner elements 5.1 . . . 5.4 can engage. In addition, the corner element 5.1 . . . 5.4 is screwed to the respective table leg 3.1 . . . 3.4. For this purpose, it has a continuous, radial opening which, in the fitted state, is oriented parallel to the table top 2 and encloses a respective angle of 45° with respect to the two adjacent surrounds 4.1 . . . 4.4. A screw is guided through this opening and driven into a thread correspondingly arranged in the table leg 3.1 . . . 3.4. Further round openings 6.1*a*, 6.1*b*, . . . , 6.4*a*, 6.4*b* can be seen in FIG. 1 on the upper side of the surrounds 4.1 . . . 4.4, into which openings a screw sleeve having an internal thread can be inserted for screwing the table top 2 to the surrounds 4.1 . . . 4.4.

Each of the table legs 3.1 . . . 3.4 has a vertical spindle 7.1, 7.2, 7.3, 7.4 which is coupled to a telescopic mechanism for adjusting the height of the table leg, which mechanism is described in more detail further below, in conjunction with FIGS. 2 and 3. At its upper end, each spindle 7.1 . . . 7.4 has a recess 8.1, 8.2, 8.3, 8.4 in the form of a hexagon socket. An Allen key or a crank with a hexagon insert bit connection can be inserted into this recess 8.1 . . . 8.4 in order to rotate the spindle 7.1 . . . 7.4 and therefore to adjust the height of the table leg 3.1 . . . 3.4 as desired.

The spindles 7.1 . . . 7.4 of respectively adjacent table legs 3.1 . . . 3.4 are synchronized by four endless toothed belts 9.1, 9.2, 9.3, 9.4. The toothed belts 9.1 . . . 9.4 are produced from a flexurally elastic material, for example based on polyurethane or of neoprene, and have a steel insert for reinforcement purposes and for limiting the length expansion. Each of the toothed belts 9.1 . . . 9.4 runs in one of the surrounds 4.1 . . . 4.4: thus, a first toothed belt 9.1 runs in the surround 4.1 between the first table leg 3.1 and the second table leg 3.2 and runs around the spindles 7.1, 7.2 of the two table legs 3.1, 3.2. The teeth of the toothed belt 9.1 are directed inwards and interact with a correspondingly toothed pulley on the spindle 7.1. A second toothed belt 9.2 runs in a corresponding manner in the surround 4.2 between the second table leg 3.2 and the third table leg 3.3 and encircles the corresponding two spindles 7.2, 7.3. In the same manner, the third table leg 3.3 is also synchronized with the fourth table leg 3.4 and the fourth table leg 3.4 in turn with the first table leg 3.1 by means of corresponding toothed belts 9.3, 9.4 running in the surrounds 4.3, 4.4.

With the height-adjustment device illustrated, a load of at least 50-75 kg can be raised. Conventional height-adjustable conference and work tables offer an infinitely variable adjustability between 680 and 760 mm as standard; in the case of the embodiment illustrated, the table legs are dimensioned in such a manner that a height adjustment in the range of approx. 680-860 mm is possible.

Figure 2:
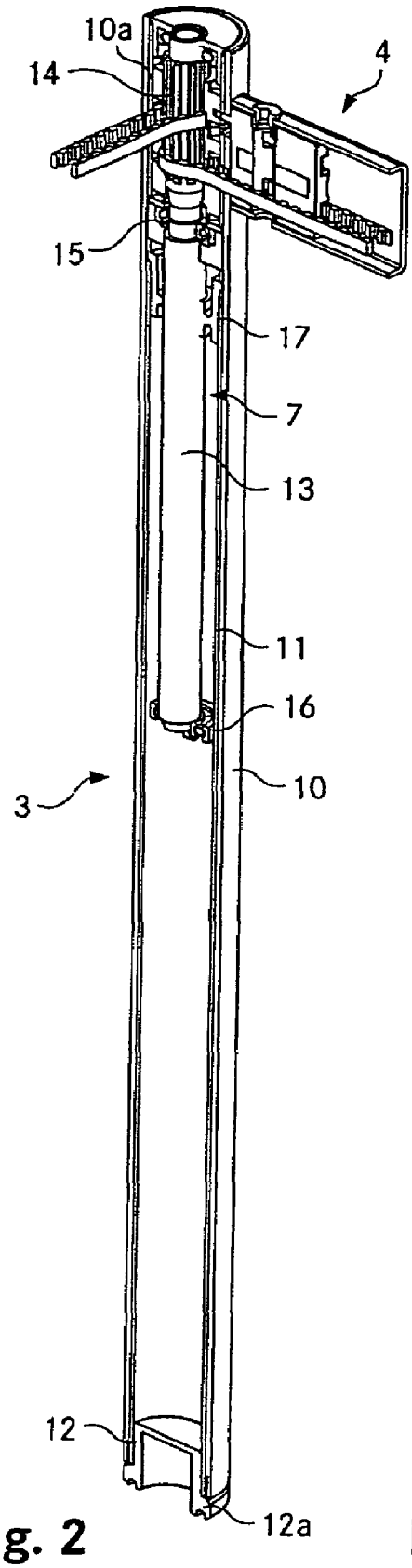
FIG. 2 shows a cut-open table leg for the height-adjustment device according to the invention in an oblique view.
Figure 3:
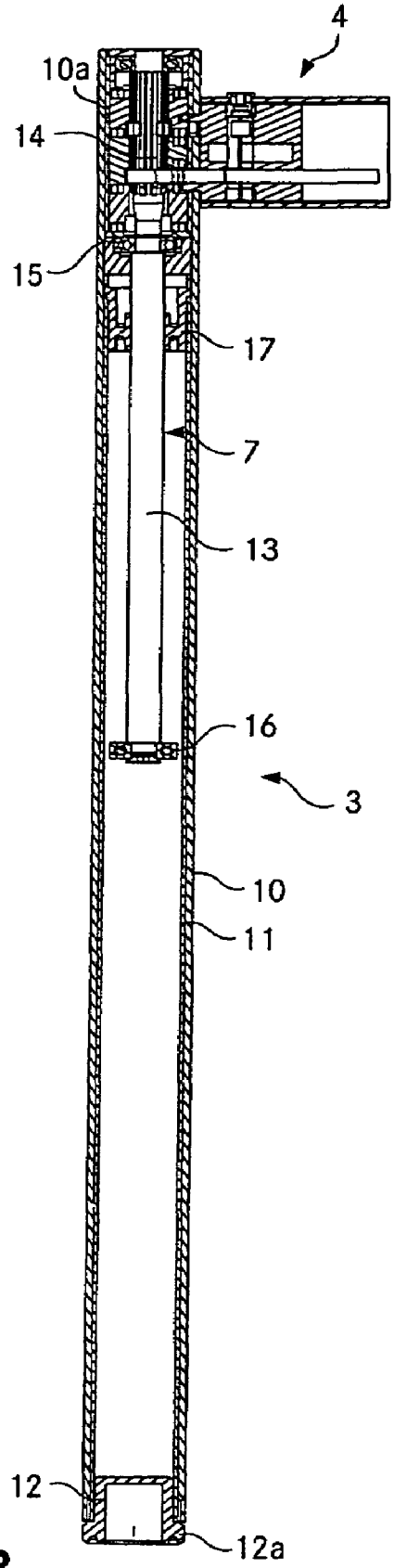
FIG. 3 shows a vertical cross section of the table leg.

FIG. 2 shows an oblique view of a cut-open table leg for the height-adjustment device according to the invention. FIG. 3 shows a corresponding cross section along a vertical plane which runs through the longitudinal axis of the table leg and a surround. The table leg 3 is formed essentially by two hollow-cylindrical telescopic tubes 10, 11 sliding one inside the other. The outer telescopic tube 10 can be seen from the outside over its entire length, and two horizontal surrounds 4 are fastened at a right angle to each other to its upper end section (one of these can be seen in FIGS. 2, 3). The inner telescopic tube 11 has an outside diameter which corresponds essentially to the inside diameter of the outer telescopic tube 10, and is guided in a sliding manner in a lower section of the outer telescopic tube 10. An inner tube 10*a*, the material, wall thickness and diameter of which correspond to the inner telescopic tube 11, but which is not coupled mechanically to the latter, is connected fixedly to the uppermost section of the outermost telescopic tube 10. The wall thickness of the inner telescopic tube 11 is smaller than the wall thickness of the outer telescopic tube 10, the mechanical stability and flexural rigidity of the table leg 3 is therefore ensured primarily by the outer telescopic tube 10. At its lower end, the inner telescopic tube 11 is connected to a foot 12 which has, below the inner telescopic tube 11, an outwardly directed flange section 12*a*, the outside diameter of which corresponds to the outside diameter of the outer telescopic tube 10. In the entirely retracted position illustrated, the table leg 3 therefore has a closed, cylindrical, outer form.

The spindle 7 is formed by a spindle part 13 and a driving part 14, the driving part 14 being mounted at its lower end in a rotationally fixed manner on the upper end of the spindle part 13. For this purpose, the two parts have matching recesses and projections; in addition, the driving part 14 is screwed to the spindle part 13 by means of a radial screw (not illustrated).

The spindle part 13 has an external thread and is arranged centrally in the interior of the upper section of the inner telescopic tube 11. The spindle part 13 is mounted rotatably, but not displaceably, in a first, upper bearing 15 and, at its lower end, in a second, lower bearing 16. The first bearing 15 is attached fixedly to the outer telescopic tube 10 above the inner telescopic tube 11. The second bearing 16 slides within the inner telescopic tube 11 and prevents the spindle part 13 from bending or tilting. At the upper end of the inner telescopic tube 11, an end piece 17 is arranged in a rotationally fixed and nondisplaceable manner. The end piece 17 has an internal thread which interacts with the external thread of the spindle part 13. As soon as the spindle 7 is rotated, a vertical movement of the inner telescopic tube 11 relative to the spindle and therefore also to the outer telescopic tube 10 arises because of the threaded connection. The inner telescopic tube 11 is therefore extended at the lower end from the outer telescopic tube 11, so that the length of the table leg 3 is increased. The ball bearings 15, 16 prevent the end piece 17 from being able to wedge at its lower or upper stop against the limiting elements by the stops being rotatable and therefore being able to be "carried along" by the end piece 17 as soon as the latter reaches its end positions.

In this embodiment, a means of securing against rotation is not provided between the inner telescopic tube 11 and the outer telescopic tube 10. However, rotation of the inner telescopic tube 11 is prevented by the friction between the foot 12, which is fitted on the inner telescopic tube 10 in a rotationally fixed manner, and the floor. The friction is easily sufficient because the foot 12 is pressed onto the floor with a considerable weight, namely one quarter of the weight of the table. The friction can be further increased by the lower side of the foot 12 being provided with a material having a high coefficient of friction. In addition, the rotatability of the inner telescopic tube 11 with respect to the outer telescopic tube 10 makes it possible for the length of the table leg to be easily levelled, for example, if there is an uneven underlying surface. Differences in length between the table legs, once the differences have been set, are maintained through synchronizing the table legs 3 during the common height adjustment of the table legs 3.

As an alternative, a means of securing against rotation which is known per se may also be provided between the telescopic tubes 10, 11. In this case, the levelling can take place by means of correspondingly adjustable feet.

Figure 4:
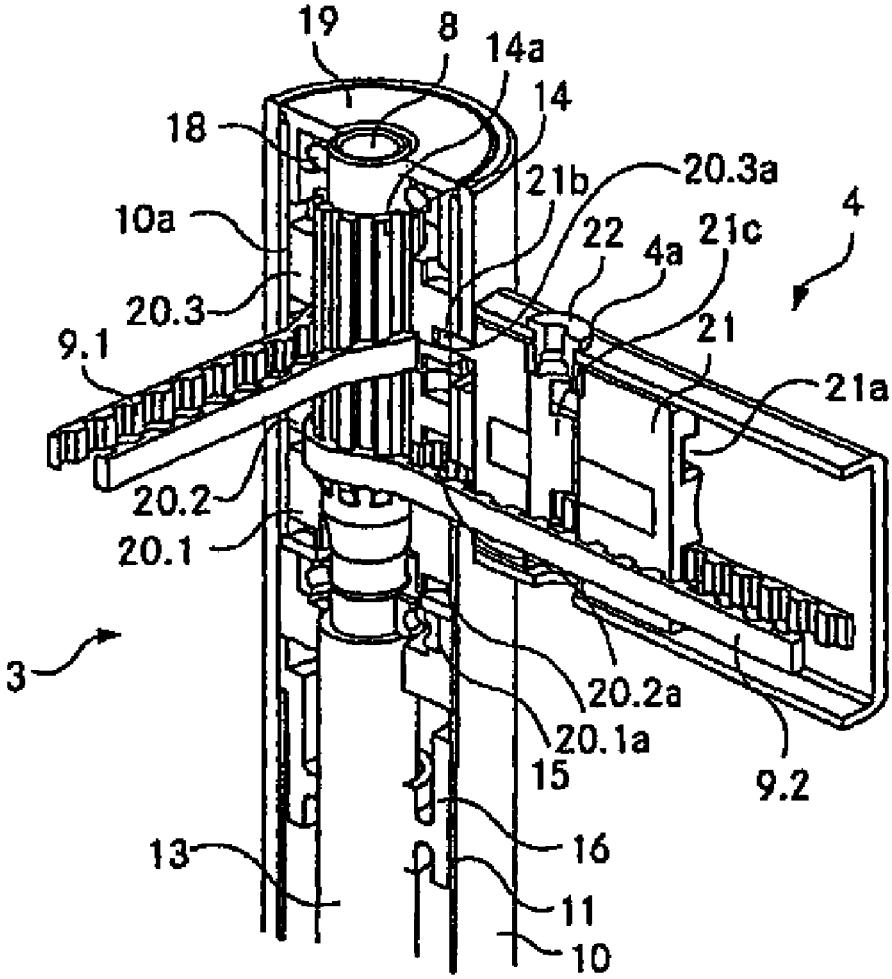
FIG. 4 shows a detailed illustration of the upper end of the table leg in an oblique view.
Figure 5:
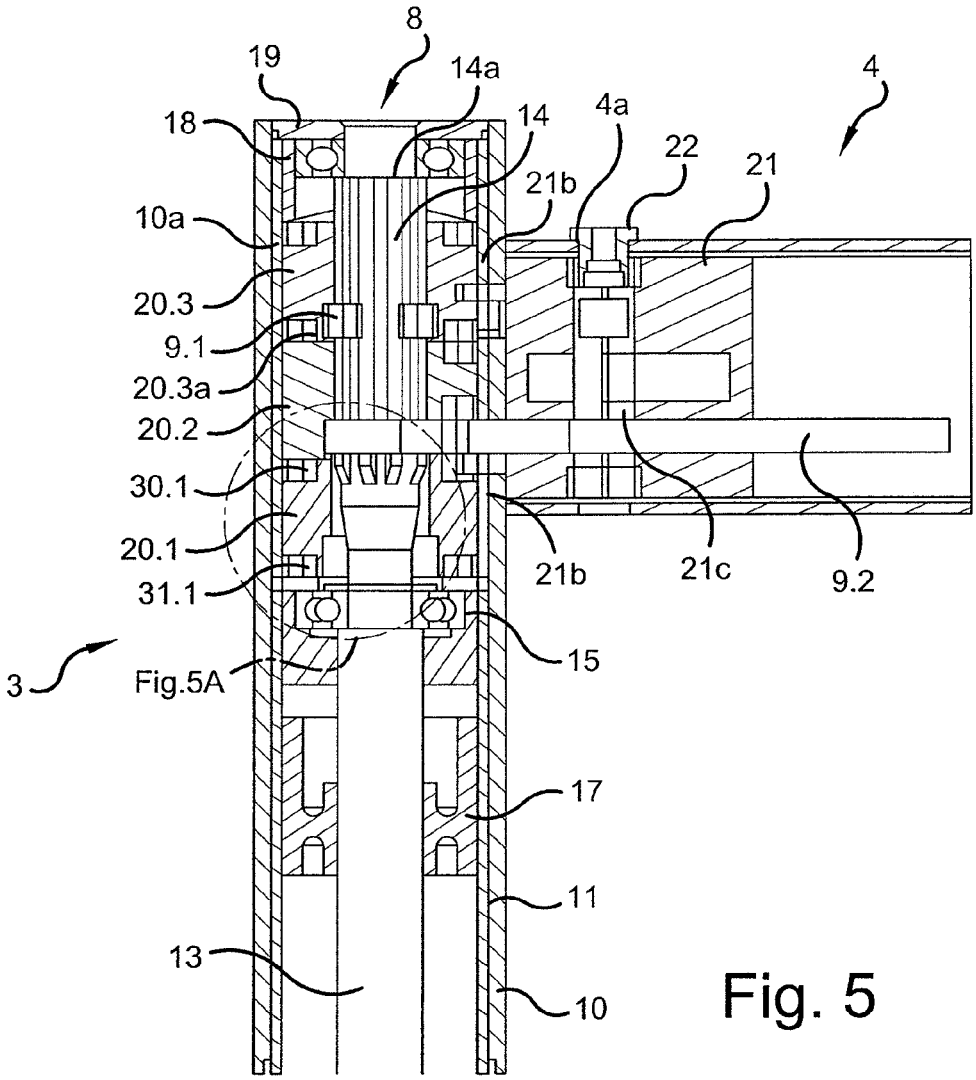
FIG. 5 shows a detailed illustration of the upper end of the table leg in a vertical cross section.

The upper end of the table leg 3 is illustrated in more detail in FIG. 4 in an oblique view and in FIG. 5 in a vertical cross section. The driving part 14 has a plurality of teeth 14*a* in the longitudinal direction which interact with the teeth of two toothed belts 9.1, 9.2 which encircle the driving part 14 at a different height.

At its upper end, the driving part 14 is mounted rotatably in a bearing 18 and runs as far as the upper end of the table leg 3. The bearing 18 is arranged on the inside in a hollow-cylindrical end element 19 which closes off the table leg 3 at its upper end and the casing of which fits precisely into the inner tube 10*a* of the table leg 3. The cover of the end element 19 has a central opening for the upper end of the driving part 14. The upper end surface of the driving part 14 is aligned with the cover of the end element 19 and has a recess 8 in the form of a hexagon socket for the actuation of the spindle 7 by means of a crank or an Allen key.

Three guide bushings 20.1, 20.2, 20.3 which are of identical design are arranged one above another between the upper bearing 18 for the driving part 14 and the fastening on the spindle part 13. They fill the intermediate space in a fitting manner, and their external cross section corresponds essentially to the internal cross section of the outer telescopic tube 10, so that they are held nondisplaceably in the table leg 3. The guide bushings 20.1 . . . 20.3 each have, along their longitudinal axes, a continuous, cylindrical opening in such a manner that the three guide bushings 20.1 . . . 20.3, which are arranged one above another, form a mount for the driving part 14 and those sections of the toothed belts 9.1, 9.2 encircling it. In addition, each of the guide bushings 20.1 . . . 20.3 has, at its lower end, a lateral opening 20.1*a* . . . 20.3*a* which is continuous from the outside of the bushing as far as the central opening. The two sections of the second toothed belt 9.2 are guided through the lateral opening 20.2*a* of the central guide bushing 20.2. The upper guide bushing 20.3 is rotated through 90° about its longitudinal axis with respect to the central guide bushing 20.2 and the two sections of the first toothed belt 9.1 are guided through its lateral opening 20.3*a*. The lateral opening 20.1*a* of the lowermost guide bushing 20.1 is not used. The lateral openings 20.1*a* . . . 20.3*a* of the guide bushings 20.1 . . . 20.3 are in the form of a circular ring section, with the outer ends of this section being designed in such a manner that they are used as guides for the smooth outside of the toothed belts 9.1, 9.2. The open angle of the openings 20.1*a* . . . 20.3*a* is selected in such a manner that the two sections of a toothed belt 9.1, 9.2, after encircling the driving part 14, are again brought together to such an extent that, as a result, they can be guided parallel to one another within the surround 4 to the next table leg 3.

Figure 5A:
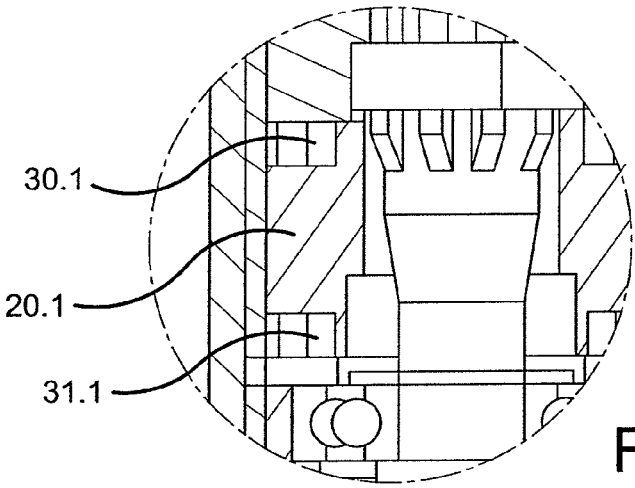
FIG. 5A shows a breakout of a section of FIG. 5.
Figure 6:
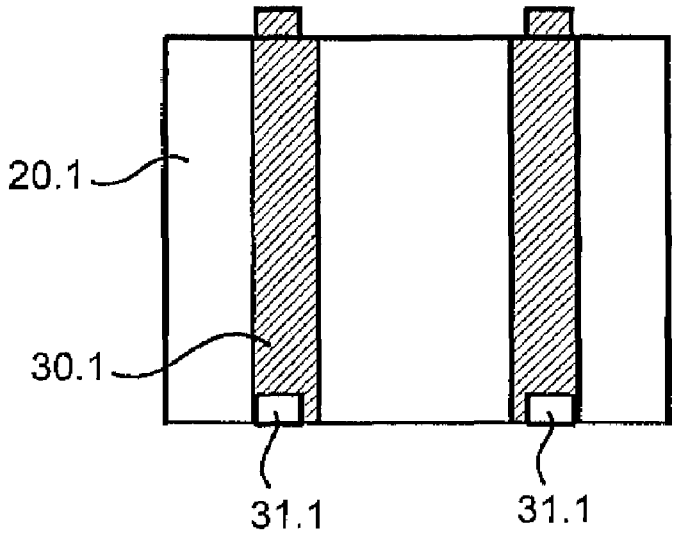
Figure 7:
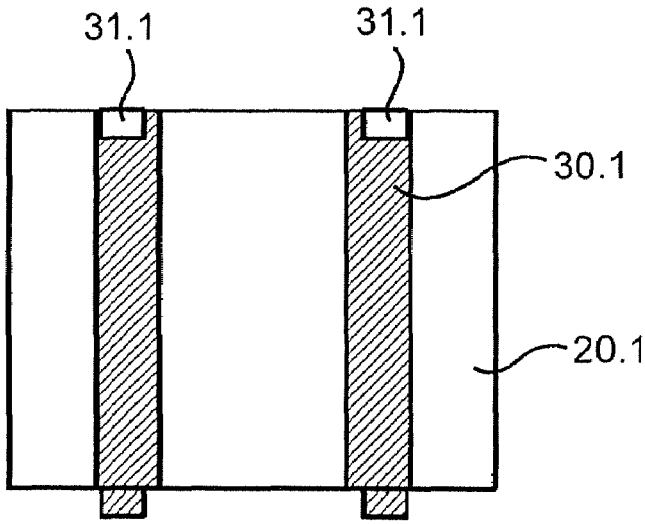
FIG. 7 shows a schematic cross-section of the guide bushing of FIG. 6.

FIG. 5A shows a breakout of a section of FIG. 5. So that the mutual orientation of the three guide bushings 20.1 . . . 20.3 is maintained, the latter have pins 30.1 on their upper side and corresponding recesses 31.1 on their lower side. The pins and recesses permit both a parallel positioning of adjacent guide bushings 20.1 . . . 20.3 and also positions rotated through 90°, 180° or 270° with respect to one another about the longitudinal axis.

Continuous openings through which the two sections of the toothed belts 9.1, 9.2 can be guided into the surrounds 4 are likewise provided in the outer telescopic tube 10 and in the inner tube 10*a*. The lateral openings 20.2*a*, 20.3*a* of the central guide bushing 20.2 and of the upper guide bushing 20.3 are aligned with the openings in the outer telescopic tube 10 and in the inner tube 10*a*.

Adjoining the table leg 3, a spacer element 21 is provided in the surround 4 and guides the sections of the toothed belt 9.2 and prevents its internal teeth from becoming wedged in one another, which would lead to the synchronization mechanism blocking. The outer shape of the spacer element 21 largely corresponds to the internal cross section of the surround 4, so that the spacer element 21 is mainly displaceable along the longitudinal axis of the surround 4. At its outer end facing the table leg 3, the spacer element 21 has a shoulder, by means of which it is supported at the end of the surround 4 and is therefore precisely positioned. Channel-like guides 21*a* are provided on the spacer element 21 parallel to its longitudinal axis on both sides of the axis and on both sides of the plane of symmetry, for accommodating one section in each case of the toothed belt 9.2. Only two opposite guides 21*a* are used in each case in each surround 4 while the others remain empty.

The spacer element 21 also has, at its inner end adjacent to the table leg 3, two cams 21*b* which are guided through matching openings in the outer telescopic tube 10, in the inner tube 10*a* and in the guide bushings 20.1 . . . 20.3. Together with the pins and recesses on the guide bushings 20.1 . . . 20.3, the cams 21*b* prevent the three guide bushings 20.1 . . . 20.3 from rotating within the table leg 3.

The surrounds 4 adjacent to a table leg 3 are held on the table leg 3 and on one another by means of the corner element 5 illustrated in FIG. 1. The corner element 5 has claws and cams which reach through openings (not visible in the figures) on the inside of the surrounds 4. Together with the (abovementioned) screwing of the corner element 5 to the table leg 3, the claws and cams ensure that the adjacent surrounds 4 are securely fastened to one another and to the table leg 3. The screw sleeve 22 for the screwing of the table top is also visible in FIGS. 4 and 5, the screw sleeve 22 being pushed through an opening 4*a* on the upper side of the surrounds 4 and running through a mount 21*c* in the spacer element 21.

The assembly of the table 1 together with the height-adjustment device according to the invention can take place as follows. First of all, matching toothed belts 9.1 . . . 9.4 are inserted into the surrounds 4.1 . . . 4.4 and a spacer element 21 is inserted at each of the two ends. The surrounds 4.1 . . . 4.4 are then fastened to the table top 2, for example are screwed to it.

The table legs 3.1 . . . 3.4 are ready pre-assembled, with the exception of the driving parts 14, the end piece 19 and the bearing 18. The guide bushings 20.1 . . . 20.3 are therefore inserted into the table leg 3.1 . . . 3.4 in a manner already oriented with respect to one another in a matching manner. The table legs 3.1 . . . 3.4 can now be fastened to the table top 2 with the surrounds 4.1 . . . 4.4 with the aid of the corner pieces 5.1 . . . 5.4, with the ends of the toothed belts 9.1 . . . 9.4 being introduced through the openings of the table legs 3.1 . . . 3.4 and of the guide bushings 20.1 . . . 20.3. When all four table legs 3.1 . . . 3.4 have been fitted in this manner, the driving parts 14 can be introduced into the guide bushings 20.1 . . . 20.3, as a result of which the toothed belts 9.1 . . . 9.4 are tightened at the same time. This operation is facilitated by the lower end of the driving parts 14 themselves and a lower region of the teeth 14*a* widening conically from bottom to top. Finally, the end pieces 19 together with the bearings 18 can be introduced into the table legs 3.1 . . . 3.4.

An existing table can also be refitted in a similar manner. The existing table legs having a fixedly predetermined length are replaced by table legs with a telescopic mechanism, belts and spacer elements are inserted into the existing surrounds, and the table is assembled again in a corresponding manner.

The invention is not restricted to the described embodiment of a height-adjustable table. In particular, the aesthetic design of the table can be changed in a very wide variety of ways. For example, the surrounds can surround the table top on the outside, and their upper side can be aligned with the upper edge of the table top. However, the surrounds may also be set back further with respect to the edge of the table top, with the table legs likewise being spaced apart from the edge of the table top. Moreover, the shape of the table is not restricted to the rectangular shape shown, and just three or more of the four table legs may be provided.

The telescopic mechanism may also be designed differently, for example it may also comprise additional, concentrically arranged telescopic tubes if the maximum lift is to be increased. The mechanism may include end stops, so that an "overtightening" of the spindles is prevented. In addition, the ball bearing at the lower end of the spindle part slides on the inside on the inner telescopic tube can also be omitted, depending on the dimensioning and material of the spindle part. The driving part may be mounted merely at its lower and its upper end while it is situated freely in the table leg in between, at the contact points with the driving means. So that the driving part withstands the corresponding, larger mechanical load, its cross section in this case is of a larger size, or a different material is selected. Depending in each case on the space available, the spacers in the surrounds may be omitted or else provided in further sections of the surrounds. Finally, as already mentioned, the synchronization of the telescopic mechanisms may also be realized in a different manner, for example by means of friction belts or V-belts or by means of chains.

In summary, it should be stressed that the invention provides a height-adjustment device which can be produced and fitted reliably, aesthetically inconspicuously and simply.

The invention claimed is:

1. Height-adjustment device for a table with three or more table legs attached in an edge region of the table, with respectively adjacent table legs being connected to one another by a horizontal, hollow-profile connecting element, comprising:

for each of the table legs, a telescopic mechanism for changing a length of a table leg, the mechanism being adjusted by rotating a rotatably mounted adjusting element, wherein the adjusting element is a vertical spindle, and a driving part connected by a rotationally fixed connection to the spindle;

a plurality of endless coupling elements which are accommodated within the hollow-profile connecting elements, wherein each said endless coupling element encircles the driving parts of two adjacent table legs and interacts therewith to respectively synchronize the adjusting elements of the table legs with each other;

a plurality of guides for the endless coupling elements, each said guide having an external cross section which essentially corresponds to an internal cross section of a table leg, a longitudinally oriented mount for the driving part, and a laterally arranged openings for guiding the endless coupling elements through, each said laterally arranged opening being of a form that, after sections of the respective endless coupling element encircle the driving part, bring together the sections to an extent that the outer sides of the endless coupling element are guided to a width that is equal to or less than an outer diameter of the driving part to within the hollow-profile connecting element, a shape of an inner surface of each guide surrounding respective endless coupling elements is such that the respective endless coupling element is guided around the driving part by the inner surface of the corresponding guide.

2. Device according to claim 1, characterized in that the adjusting elements interact with a telescopic element of the telescopic mechanism via a thread.

3. Device according to claim 1, characterized in that the endless coupling elements are belts, toothed belts, or chains.

4. Device according to claim 1, characterized by a spacer arranged in the hollow-profile connecting elements, or guiding the two opposite sections of the endless coupling elements in the hollow-profile connecting elements.

5. Device according to claim 1, characterized in that each of the guides is formed by at least three guide bushings arranged longitudinally in contact end-to-end, with two of said at least three guide bushings having respective two said laterally arranged openings for the endless coupling elements.

6. Device according to claim 5, characterized in that each of the guides is formed by precisely three identical guide bushings having pins on an upper side and corresponding recesses on a lower side, the pins and recesses allowing the guides to be plugged one on top of the other with different orientations of said two laterally arranged openings.

7. Device according to claim 1, characterized in that the telescopic mechanism of one of the table legs is designed such that an actuating means for adjusting the height of the table can be coupled directly in a rotationally fixed manner to the adjusting element.

8. Device according to claim 7, characterized in that the telescopic mechanism of each of the table legs has coupling for the optional coupling of the actuating means.

9. Device according to claim 1, characterized in that the hollow-profile connecting elements run between the table legs and in that lateral openings for guiding the endless coupling elements through into the hollow-profile connecting elements are provided in the table legs.

10. Device according to claim 8, characterized in that the coupling for the optional coupling of the actuator means is a plug-in connection for a crank.

11. A height-adjustable table comprising:

three or more table legs attached in an edge region of the table;

a plurality of horizontal, hollow-profile connecting elements being connected between respectively adjacent table legs;

for each of the table legs, a telescopic mechanism for changing a length of a table leg, the mechanism being adjusted by rotating a rotatably mounted adjusting element, wherein the adjusting element is a vertical spindle, and a driving part connected by a rotationally fixed connection to the spindle;

a plurality of endless coupling elements which are accommodated within the hollow-profile connecting elements, wherein each said endless coupling elements encircles the driving parts of two adjacent table legs and interacts therewith to respectively synchronize the adjusting elements of the table legs with each other; and a plurality of guides for the endless coupling elements, each said guide having an external cross section which essentially corresponds to an internal cross section of a table leg, a longitudinally oriented mount for the driving part, and a laterally arranged openings for guiding the endless coupling elements through, each said laterally arranged opening being of a form that, after sections of the respective endless coupling element encircle the driving part, bring together the sections to an extent that the outer sides of the endless coupling element are guided to a width that is equal to or less than an outer diameter of the driving part to within the respective hollow-profile connecting element, a shape of an inner surface of each guide surrounding respective endless coupling elements is such that the respective endless coupling element is guided around the driving part by the inner surface of the corresponding guide.

12. Method for retrofitting a table with three or more table legs attached in an edge region of the table, with respectively adjacent table legs being connected to one another by a horizontal, hollow-profile connecting element, with a height-adjustment device, characterized by the following steps:

a) replacing the table legs with height-adjustable table legs having a telescopic mechanism for changing a length of the table leg, the telescopic mechanism being adjustable by rotating a rotatably mounted adjusting element, the telescopic mechanism including a driving part connected by a rotationally fixed connection to adjusting element;

a plurality of guides each having an external cross section which essentially corresponds to an internal cross section of the table legs, a longitudinally oriented mount for the driving part, an internal cross section shaped to guide the endless coupling element around the driving part, and a laterally arranged openings, wherein each said laterally arranged opening is of a form that, after sections of the respective endless coupling element encircle the driving part, bring together the sections to an extent that the outer sides of the endless coupling elements are guided to a width that is equal to or less than an outer diameter of the driving part, through and within the respective hollow-profile connecting element;

b) introducing a plurality of endless coupling elements for the mechanical synchronization of the adjusting elements of adjacent table legs into the hollow-profile connecting element connecting the respective table legs, wherein each said endless coupling element encircles the driving parts of the adjusting element of adjacent table legs and therefore interact therewith; and c) coupling the endless coupling elements to the adjusting elements, wherein the adjusting elements are spindles.

* * * * *